US006975340B2

(12) United States Patent
Hoshino et al.

(10) Patent No.: US 6,975,340 B2
(45) Date of Patent: Dec. 13, 2005

(54) THERMALLY ACTIVATING APPARATUS

(75) Inventors: Minoru Hoshino, Chiba (JP); Yoshinori Sato, Chiba (JP)

(73) Assignee: Seiko Instruments Inc., Chiba (JP)

( * ) Notice: Subject to any disclaimer, the term of this patent is extended or adjusted under 35 U.S.C. 154(b) by 84 days.

(21) Appl. No.: 10/766,588

(22) Filed: Jan. 28, 2004

(65) Prior Publication Data

US 2004/0217099 A1 Nov. 4, 2004

(30) Foreign Application Priority Data

Feb. 13, 2003 (JP) ..... 2003-034788

(51) Int. Cl.[7] ..... B41J 25/304
(52) U.S. Cl. ..... 347/197; 400/120.16
(58) Field of Search ..... 347/197, 198; 400/120.16, 120.17

(56) References Cited

U.S. PATENT DOCUMENTS 5,366,302 A 11/1994 Masumura et al. .... 400/120.16
5,628,572 A * 5/1997 Sato et al. ..... 400/322

FOREIGN PATENT DOCUMENTS

EP 1052107 11/2000

OTHER PUBLICATIONS

Patent Abstracts of Japan, vol. 2002, No. 5, May 3, 2002, publication No. 2002019167, publication date Jan. 23, 2002.
Patent Abstracts of Japan, vol. 2000, No. 13, Feb. 5, 2001, publication No. 2000289286, publication date Oct. 17, 2000.
Patent Abstracts of Japan, vol. 1997, No. 12, Dec. 25, 1997, publication No. 09216394, publication date Aug. 19, 1997.

* cited by examiner

*Primary Examiner*—Huan Tran
(74) *Attorney, Agent, or Firm*—Adams & Wilks

(57) ABSTRACT

A thermally activating apparatus comprises a main body frame (1), a thermal head (4) for heating a sheet, a first head holding member (5*a*) for holding the thermal head from a back portion thereof, a platen roller (2) arranged in parallel with the thermal head and paper feeding means (8*a* through 8*c*) for transporting the sheet after having been heated by the thermal head, and a second head holding member (5*b*) having a first support shaft (6*a*) in parallel with the thermal head and the holding the first head holding member pivotably by the first support shaft, wherein the second head holding member is pivotably supported by a second support shaft (6*b*) arranged in parallel with the thermal head and transversely hung rotatably between side walls of the main body frame and the thermal head is constituted to be able to be proximate to and remote from the platen roller by constituting centers of rotation by two shafts of the first support shaft and the second support shaft.

7 Claims, 6 Drawing Sheets

THERMALLY ACTIVATING APPARATUS

BACKGROUND OF THE INVENTION

The present invention relates to a mechanism of opening and closing an apparatus of thermally activating a thermally sensitive adhering sheet, particularly relates to a technology effective by being utilized in a thermally activating apparatus provided with a thermal head having a heat generating element as heating means.

Description of the Related Art

In recent years, there is a thermally activated sheet as one of sheets pasted on commodities (for example, printing media formed with a coating layer including a thermally active component on a surface thereof such as a thermally sensitive adhering sheet) which is used in a wide field of pasting, for example, POS sheet of food product, physical distribution and delivery sheet, medical sheet, baggage tag, display sheet of bottles and cans and so on.

The thermally sensitive adhering sheet is constituted by respectively forming a thermally sensitive adhering agent layer normally showing nonadhering performance and manifesting adhering performance by being heated on one face of a sheet-like base member and a printable face on other face.

There has been proposed a printer for such a thermally sensitive adhering sheet having a thermally activating apparatus for heating a thermally sensitive adhering agent layer by bringing a head having a plurality of resistors (heat generating elements) as a heat source provided on a ceramic base plate into contact with a thermally sensitive adhering label as in a thermal head utilized as a printing head of a thermal printer (Patent Document 1).

[Patent Document 1]

JP-A-11-79152

Meanwhile, the thermally activating apparatus constituting heating means by the thermal head is constructed by a constitution in which the adhering face of the thermally sensitive adhering sheet is directly heated by the thermal head and therefore, a portion of the adhering agent is liable to exfoliate to adhere to the thermal head or a platen roller. Therefore, the thermal head and the platen roller are provided with a necessity of cleaning and interchanging more than that of other part. However, owing to a type of bringing the thermal head into press contact with the platen roller and inserting the thermally sensitive adhering sheet between the thermal head and the platen roller to thereby heat by the thermal head, the thermal head and the platen roller are arranged to be considerably proximate to each other and therefore, unless an opening and closing mechanism for separating the thermal head and the platen roller is provided, operation of cleaning or interchanging the head is made to be difficult to carry out.

Meanwhile, when the thermal head is repeatedly subjected to a heating processing for activation, a peripheral temperature thereof is gradually elevated and therefore, in the thermally sensitive adhering sheet for the thermal printer, when paper after having been activated remains at a vicinity of the thermal head, there is a concern of coloring the thermally sensitive face. Hence, the inventors have investigated to provide a discharge roller on the downstream side of the thermal head and the platen roller.

As a result, it has been found that when the discharge roller is provided on the downstream side of the thermal head and the platen roller, the thermal head and the platen roller cannot sufficiently be separated from each other by a simple opening and closing mechanism for simply pivoting a head holder holding the thermal head and there poses a problem that operation of cleaning or interchanging the thermal head and the platen roller is made to be difficult to carry out.

SUMMARY OF THE INVENTION

It is an object of the invention to enable to easily carry out operation of cleaning or interchanging a head by sufficiently separating an interval between a thermal head and a platen roller in a thermally activating apparatus of a thermally sensitive adhering sheet having a thermal head.

It is other object of the invention to enable to prevent a thermally sensitive face from being colored when a thermally sensitive adhering sheet for a thermal printer is used by a sheet after having been activated remaining at a vicinity of a thermal head without deteriorating operability of cleaning or interchanging of the head in a thermally activating apparatus of the thermally sensitive adhering sheet having the thermal head.

The invention has been carried out by paying attention to the above-described problem and in a thermally activating apparatus including a main body frame, a thermal head for heating a sheet, a first head holding member for holding the thermal head from a back portion thereof, a platen roller arranged in parallel with the thermal head and paper feeding means for transporting the sheet after having been heated by the thermal head wherein the thermally activating apparatus comprising a second head holding member having a first support shaft in parallel with the thermal head for holding the first head holding member pivotably by the first support shaft, the second head holding member is pivotably supported by a second support shaft arranged in parallel with the thermal head and transversely hung rotatably between side walls of the main body frame and the thermal head is constituted to be able to be proximate to and remote from the platen roller by constituting centers of rotation by two shafts of the first support shaft and the second support shaft.

According to the above-described means, an interval between the thermal head and the platen roller is considerably opened by pivoting the first head holding member holding the thermal head centering on the first support shaft and pivoting the second head holding member centering on the second support shaft.

Further, preferably, the paper feeding means is attached to the second head holding member. Thereby, when the interval between the thermal head and the platen roller is opened by pivoting the first head holding member and the second head holding member, the paper feeding means is also pivoted along therewith and therefore, the paper feeding means is moved to a position of not hindering operation of cleaning or interchanging the thermal head and the platen roller.

Further, a side portion of the platen roller is provided with a gear transmission mechanism for driving to rotate the platen roller, the paper feeding means is provided with a rotating shaft arranged in parallel with the thermal head and a gear attached to an end portion of the rotating shaft, and the gear is constituted to be brought in mesh with any of gears constituting the gear transmission mechanism for driving to rotate the platen roller when the thermal head is brought into a state of being brought into contact with the platen roller. Thereby, the constitution of the apparatus is simplified since the paper feeding means can be driven to rotate by a drive source common to that of the platen roller.

Further, the paper feeding means includes two rotating shafts arranged in parallel with the thermal head, a belt wound around the two rotating shafts and a gear attached to an end portion of either one shaft of the two rotating shafts and the gear is constituted to brought in mesh with any of gears constituting the gear transmission mechanism for driving to rotate the platen roller when the thermal head is brought into a state of being brought into contact with the platen roller. A distance of transporting the sheet is prolonged by constituting the paper feeding means by the two rotating shafts and the belt in this way and therefore, a failure in transportation is made to be difficult to be brought about.

Here, it is preferable that a plurality of pieces of the belts are wound therearound at predetermined intervals along a length direction of the two rotating shafts. Thereby, a contact area of an adhering face of the activated sheet and the belt is reduced and therefore, it can be avoided that the adhering face is adhered to the belt to bring about a failure in transportation.

Further, the first head holding member is provided with heat radiating means for escaping heat generated at the thermal head. Thereby, it can be avoided that the temperature of the thermal head becomes excessively high and when the interval between the thermal head and the platen roller is opened by pivoting the head holding member holding the thermal head, the heat radiating means is pivoted along therewith.

Further, a side wall of the main body frame is provided with a locking pin, a side portion of the first head holding member is attached with a coupling piece having a recessed portion engageable with the locking pin pivotably by a third support shaft and the first head holding member and the second head holding member are constituted to be integrated with the frame by engaging the locking pin and the recessed portion to thereby hold the thermal head in a state of being brought into contact with the platen roller. Thereby, the head holding member can be integrated to the frame by only pivoting the head holding member in a direction of making the thermal head proximate to the platen roller.

Here, the recessed portion of the coupling piece may be formed in a shape of a circular arc centering on the third support shaft. Thereby, the recessed portion of the coupling piece can easily be engaged with the locking pin on the side of the frame by bringing the thermal head into contact with the platen roller by pivoting the head holding member and thereafter pivoting the coupling piece centering on the third support shaft.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERED EMBODIMENT

A preferable embodiment of the invention will be explained in reference to the drawings as follows.

Figure 1:
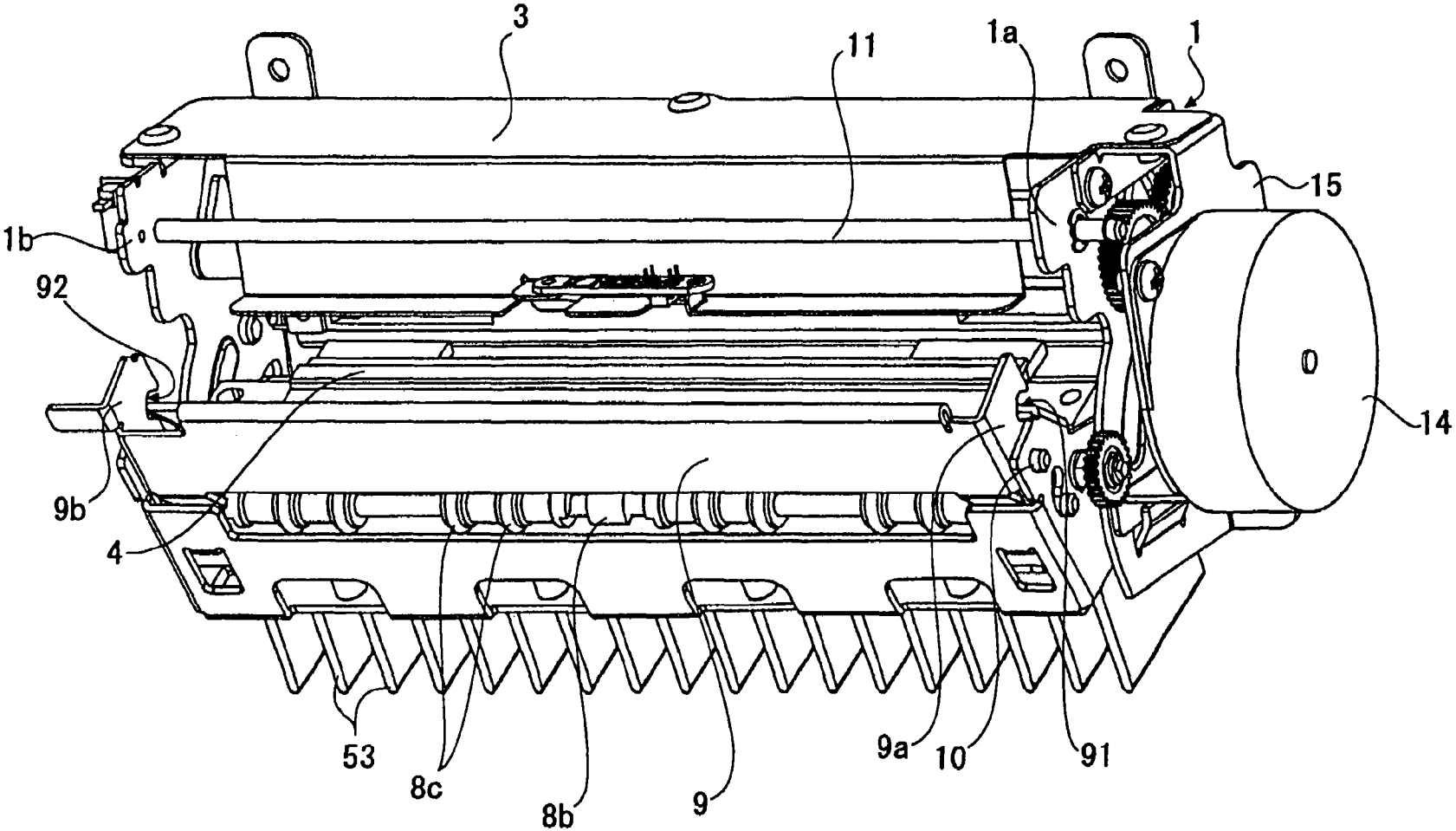
FIG. 1 is a perspective view in a state of opening a head holder showing an embodiment of a thermally activating apparatus according to the invention.
Figure 2:
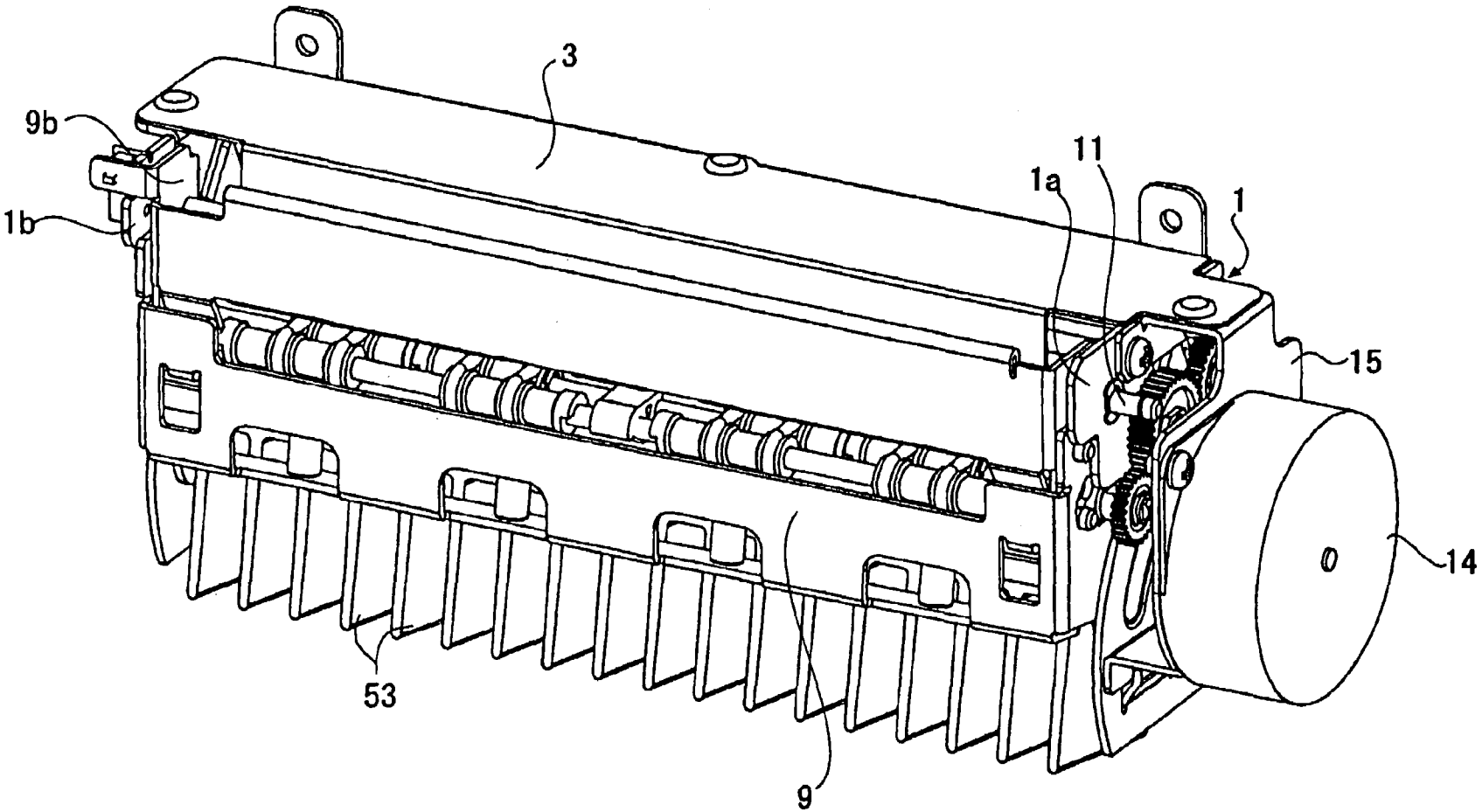
FIG. 2 is a perspective view of a state of closing the head holder showing an embodiment of the thermally activating apparatus according to the invention.
Figure 3:
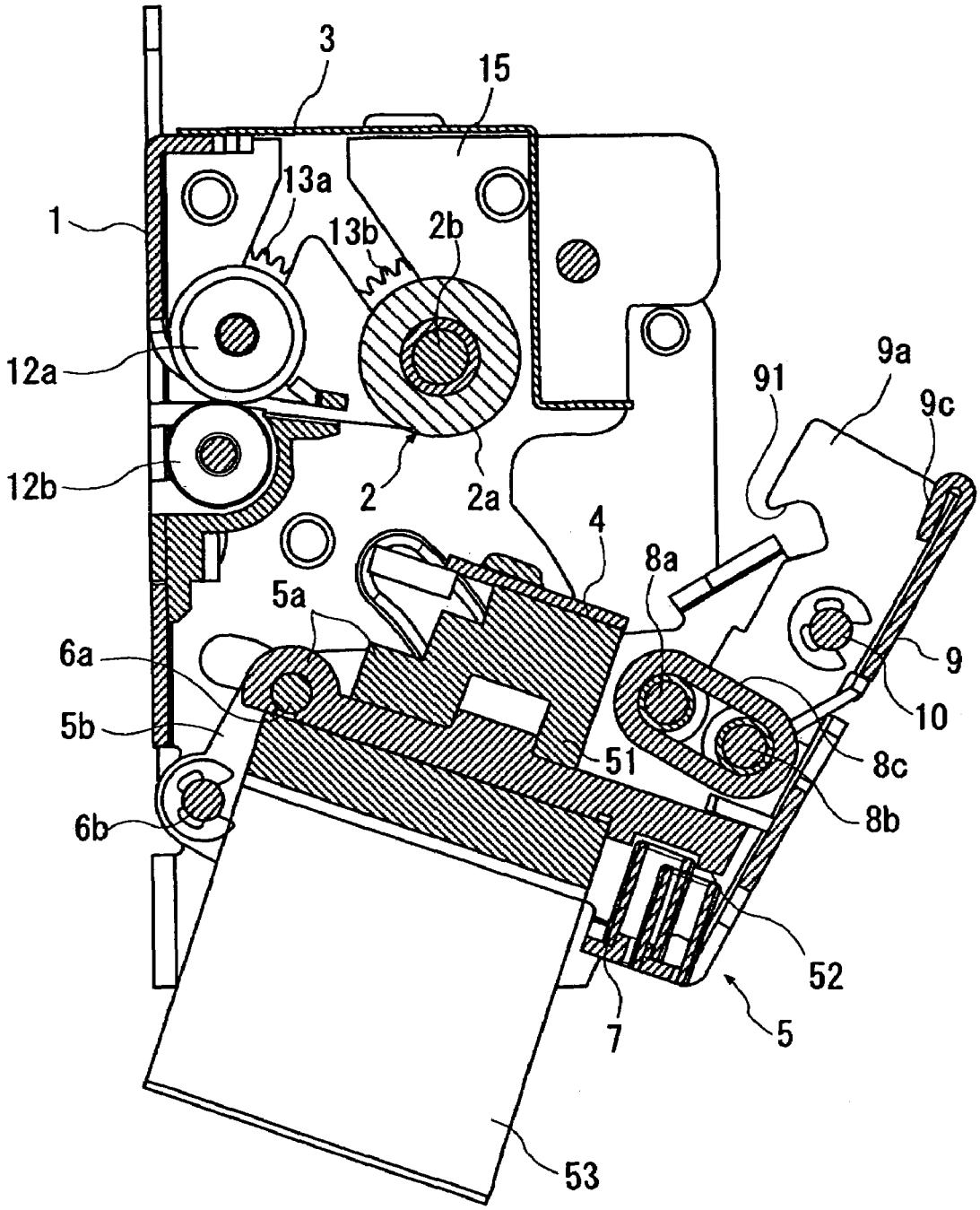
FIG. 3 is a side view of a section cut by a face orthogonal to a shaft of a platen roller substantially at a central portion thereof in the state of opening the head holder of the thermally activating apparatus of the embodiment.
Figure 4:
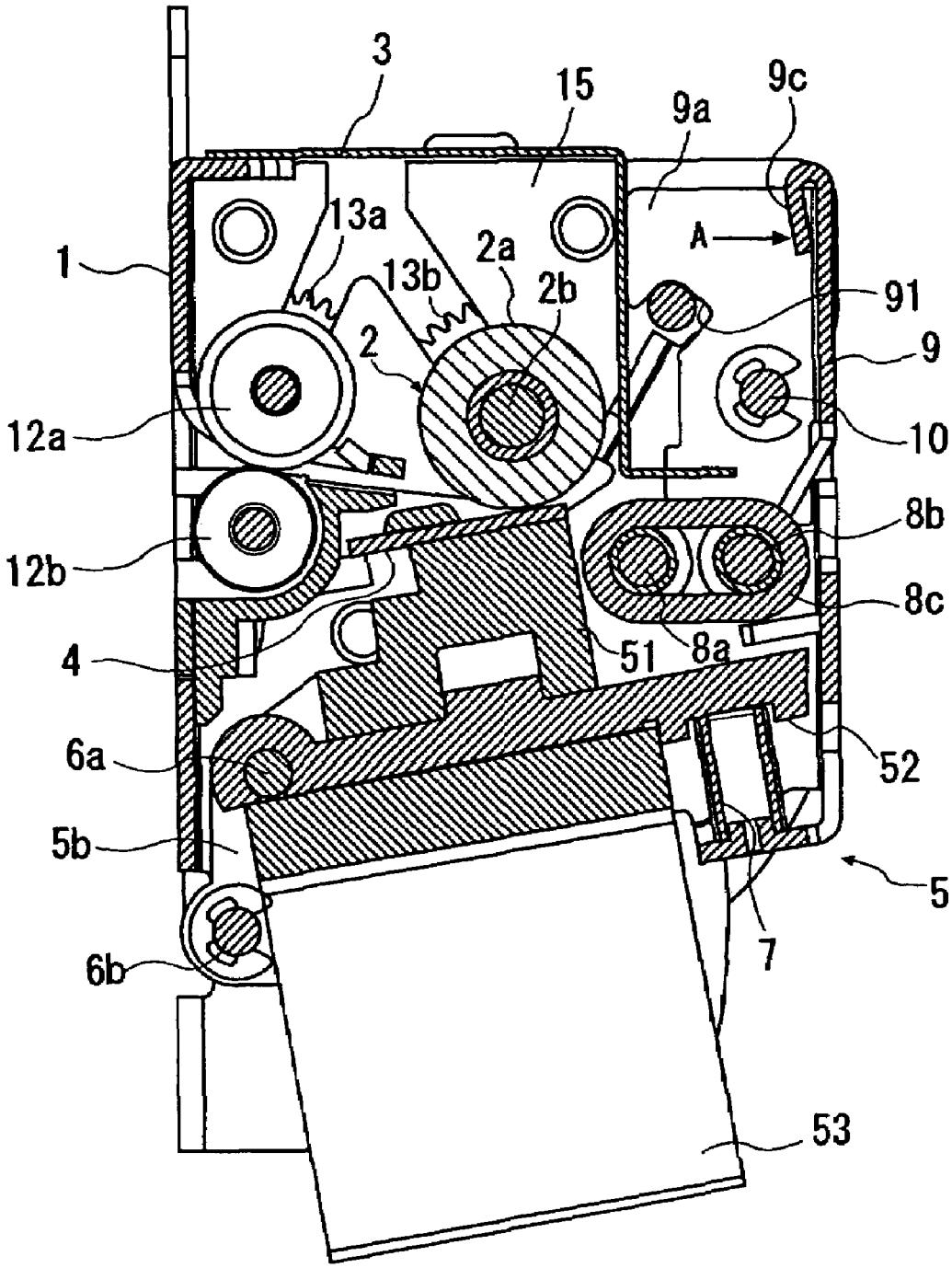
FIG. 4 is a side view of the section cut by the face orthogonal to a shaft of the platen roller substantially at the central portion in the state of closing the head holder of the thermally activating apparatus of the embodiment.
Figure 5:
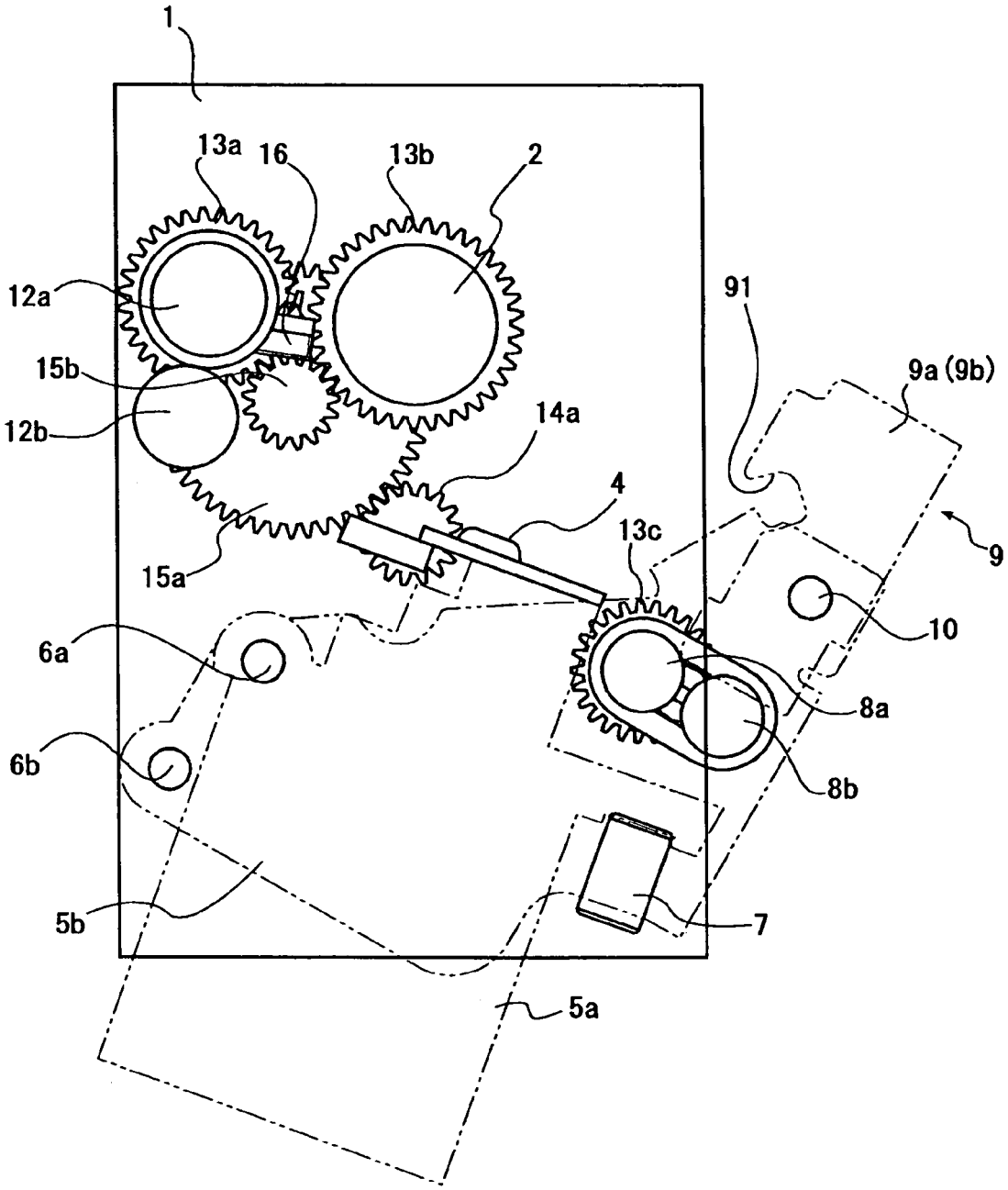
FIG. 5 is a side view of a section showing a state of opening the headholder of a gear transmission mechanism provided at a side portion of the thermally activating apparatus of the embodiment.
Figure 6:
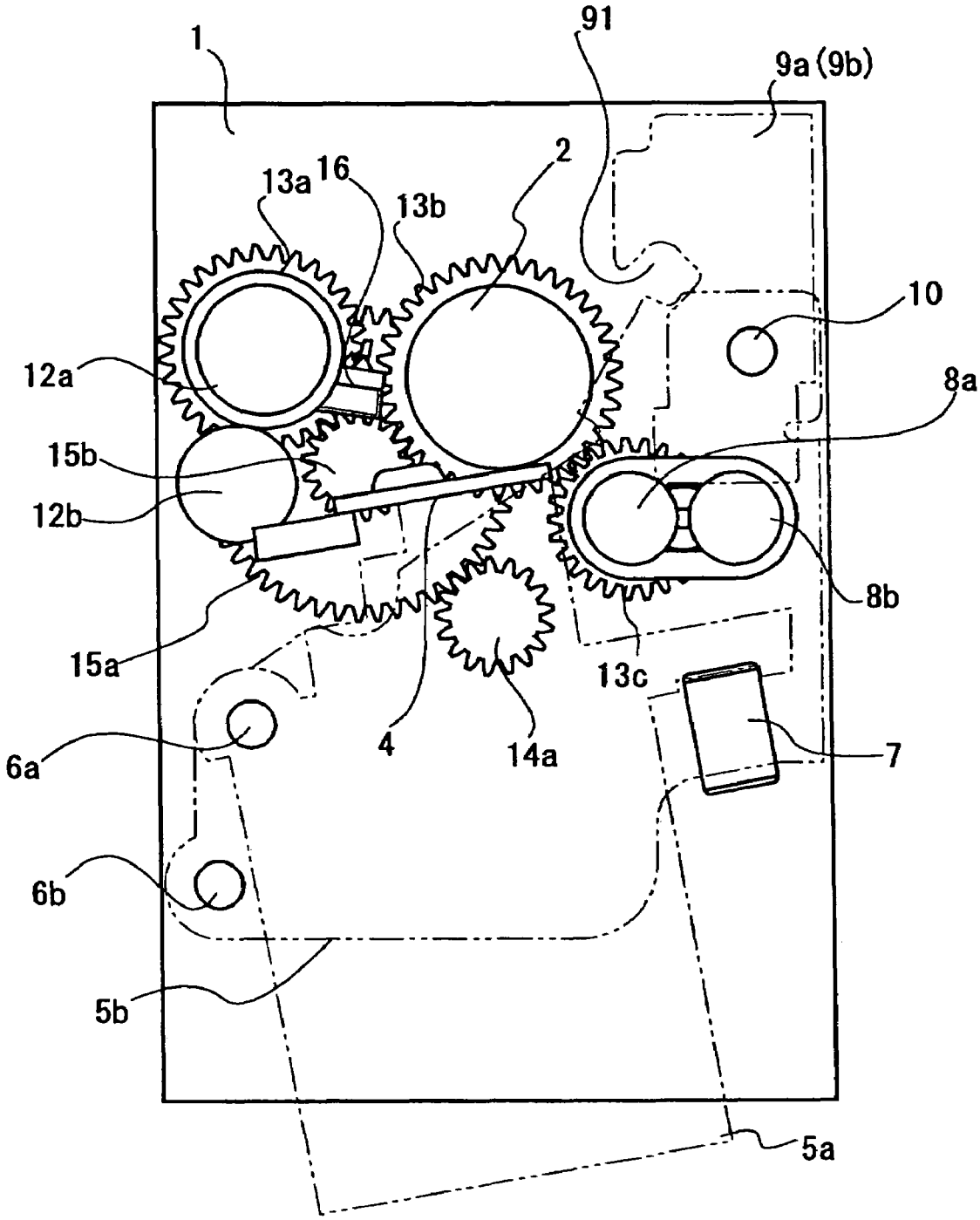
FIG. 6 is a side view of a section showing a state of closing the head holder of the gear transmission mechanism provided at the side portion of the thermally activating apparatus of the embodiment.

FIG. 1 and FIG. 2 are perspective views showing an embodiment of a thermally activating apparatus of a thermally sensitive adhering sheet having a thermal head according to the invention, FIG. 3 and FIG. 4 are side views of a section cut by a face orthogonal to a shaft of a platen roller substantially at a central portion of the thermally activating apparatus, and FIG. 5 and FIG. 6 are side views of a section showing a gear transmission mechanism provided at a side portion of the thermally activating apparatus for transmitting a rotational force. In the drawings, FIG. 1 and FIG. 3 and FIG. 5 show a state of opening a head holder such that the thermal head and the platen roller are separated from each other and FIG. 2 and FIG. 4 and FIG. 6 show a state of closing the head holder.

In FIG. 1, notation 1 designates a main body frame of a thermally activating apparatus, notation 2*a* designates a platen roller shaft hung transversely between side walls 1*a* and 1*b* of the main body frame 1, and notation 3 designates an upper frame mounted to an upper end of the main body frame 1 to cover a platen roller 2. As shown by FIG. 3, the platen roller 2 is constituted by the support shaft 2*a* and a friction roller 2*b* comprising a cylindrical elastic member mounted thereto. Further, a motor frame 15 is attached with a motor 14 for driving to rotate the platen roller 2.

Notation 4 designates a thermal head arranged in parallel with the platen roller 2 and notation 5 designates a head holder pivotably attached to the main body frame 1 to cover a front face of the main body frame 1 for holding the thermal head 4. As shown by FIG. 3, the head holder 5 is constituted by a first head holding member 5*a* directly holding the thermal head 4 and a second head holding member 5*b* for holding the thermal head 4 indirectly via the first head holding member 5*a*.

The first head holding member 5*a* comprises a base 51 for fixing the thermal head 4 and a plate 52 fixedly attached with the base 51, the plate 52 is pivotably attached to the second head holding member 5*b* by a support shaft 6*a* and the second head holding member 5*b* is pivotably attached to the side walls of the frame 1 by a support shaft 6*b*. The thermal head 4 is constituted to be able to be proximate to and remote from the platen roller 2 by pivoting the first head holding member 5*a* centering on the support shaft 6*a* and pivoting the second head holding member 5*b* centering on the support shaft 6*b* in this way to thereby considerably open an interval between the head holder 5 and the upper frame 3. Further, a face of the plate 52 of the first head holding member 5*a* opposed to the thermal head 4 is provided with a heat radiating plate 53 provided with a plurality of blades in parallel with each other.

Further, a compression spring 7 is interposed between a front end portion of the plate 52 of the first head holding member 5*a* and a front end portion of the second head holding member 5*b* and is constituted to be able to the press thermal head 4 to the platen roller 2 by spring force of the compression spring 7 when the head holder 5 is brought into a closed state.

Further, a front end portion of the second head holding member 5*b* is rotatably attached with a pair of discharging rollers 8*a* and 8*b*. Outer peripheries of the discharging rollers 8*a* and 8*b* are wound with a plurality of transporting belts 8*c* at pertinent intervals and attaching positions of the discharging rollers 8*a* and 8*b* are determined such that an transporting face (linear portion) of the transporting belt 8*c* is disposed on an extended line of a heating face of the thermal head 3. Thereby, the thermally sensitive adhering sheet which is thermally activated by the thermal head 3 is made to be able to be remote swiftly from the thermal head 3 by the transporting belt 8*c*.

Further, an upper portion of a front end of the second head holding member 5*b* is attached with a coupling piece 9 for being fixed to the main body frame 1 in a state of closing the head holder 5 pivotably by a support shaft 10. The coupling piece 9 is formed in a channel-like shape as a whole and formed with recessed portions 91 and 92 engageable with a locking pin 11 transversely hung between the side walls 1*a* and 1*b* of the main body frame 1 at wing portions 9*a* and 9*b* at both ends thereof. A predetermined clearance is formed between an upper end of the front face cover plate 55 and a lower end of a front wall of the coupling piece 9 and the thermally sensitive adhering sheet the adhering face of which is activated by the thermal head 4 is discharged from the clearance in a front direction.

As shown by FIG. 3 and FIG. 4, the thermally activating apparatus of the embodiment is rotatably attached with a pair of inserting rollers 12*a* and 12*b* for feeding the thermally sensitive adhering sheet to the platen roller 2 in parallel with the platen roller 2 and in a state of bringing outer peripheries thereof into contact with each other on a side of the platen roller 2 opposed to the discharging rollers 8*a* and 8*b*.

As shown by FIG. 5 and FIG. 6, end portions of support shafts of the inserting roller 12*a* and the platen roller 2 and the discharging roller 8*a* are fixedly attached with gears 13*a*, 13*b* and 13*c* for respectively transmitting the rotational force from the drive motor 14 to corresponding rollers. Among the gears, the gears 13*a* and 13*b* are brought in mesh with a pinion 15*b* coaxial with a speed reducing gear 15*a* which is brought in mesh with a drive gear 14*a* attached to a drive shaft of the motor 14. Further, the gear 13*c* is set with an attaching position thereof to be brought in mesh with the gear 13*b* at an end portion of the support shaft 2*a* of the platen roller 2 in the state of closing the head holder 5. Further, in FIG. 5, notation 16 designates a sensor for detecting a sheet.

According to the thermally activating apparatus of the embodiment, when the finger is touched to an inner side of an upper end fold back portion 9*c* of the coupling piece 9 shown in FIG. 4 to exert force to fall to an outer side (right side in the drawing) as shown by an arrow mark A, a total of the head holder 5 is made pivotable in the front direction by disengaging engagement between the recessed portions 91 and 92 and the locking pin 11 on the side of the main body frame 1 by pivoting the coupling piece 9 centering on the support shaft 10. At this occasion, according to the head holder 5, as shown by FIG. 3, the interval between the head holder 5 and the upper frame 3 is considerably opened by pivoting the first head holding member 5*a* centering on the support shaft 6*a* and pivoting the second head holding member 5*b* centering on the support shaft 6*b*. Therefore, operability of cleaning and, interchanging the thermal head 4 and the platen roller 2 is considerably promoted.

In order to recover the opened head holder 5 to an original position, the front face plate 55 of the second head holding member 5*b* is pushed to the inner side in a state of falling the coupling piece 9 to the outer side and the coupling piece 9 is pivoted in the direction reverse to the arrow mark A in FIG. 4 in the state of bringing the thermal head 4 and the platen roller 2 into contact with each other. Then, the recessed portions 91 and 92 of the coupling piece 9 and the locking pin 11 on the side of the main body frame 1 are engaged with each other to thereby integrate the head holder 5 and the main body frame 1 in an attitude as shown by FIG. 4.

Although a specific explanation has been given of the invention carried out by the inventors based on the embodiment as described above, the invention is not limited to the above-described embodiment but can be modified variously. For example, although according to the above-described embodiment, paper feeding means comprising the pair of discharging rollers 8*a* and 8*b* and the plurality of belts 8*c* wound therearound for swiftly discharging the activated thermally sensitive adhering sheet is attached to the second head holding member 5*b* of the head holder, the paper feeding means can also be attached to the first head holding member 5*a* or the main body frame 1.

Further, the paper feeding means is not limited to means constituted by the pair of discharging rollers and the plurality of belts wound therearound but, for example, means omitting the belt or means of using a single belt continuous in the length direction of the rollers may be used in place of the plurality of belts. In that case, in order to prevent the adhering face of the activated sheet from being adhered to the rollers or the belt to entrap, it is preferable to devise to reduce a contact area with a sheet by sprinkling a plurality of projections on a surface of the roller or the belt or forming a projected portion in a rib-like shape or devise to select a material by using a belt made of teflon or the like.

Further, although according to the embodiment, the inserting rollers 12*a* and 12*b* are provided on the upstream side of the platen roller 2 and the thermal head 4, the invention is also applicable to a thermally activating apparatus which is not provided with inserting transporting means.

Further, although according to the embodiment, the gear provided at the end portion of the discharging roller 8*a* is constituted to be brought in mesh with the gear at the end portion of the platen roller 2, the gear can also be constituted to be brought in mesh with other gear constituting the gear transmission mechanism.

Further, the thermally activating apparatus of the embodiment is applicable to a printing apparatus of a thermally transcribing type as in the thermal printer as well as an inkjet type, a laser print type or the like.

As explained above, according to the invention of Claim 1, in a thermally activating apparatus including a main body frame, a thermal head for heating a sheet, a first head holding member for holding the thermal head from a back portion thereof, a platen roller arranged in parallel with the thermal head and paper feeding means for transporting the sheet after having been heated by the thermal head wherein the thermally activating apparatus comprising a second head holding member having a first support shaft in parallel with the thermal head for holding the first head holding member pivotably by the first support shaft, the second head holding member is pivotably supported by a second support shaft arranged in parallel with the thermal head and transversely hung rotatably between side walls of the main body frame and the thermal head is constituted to be able to be proximate to and remote from the platen roller by constituting centers of rotation by two shafts of the first support shaft and the second support shaft and therefore, the interval between the thermal head and the platen roller is considerably opened by pivoting the first head holding member holding the thermal head centering on the first support shaft and pivoting the second head holding member centering on the second support shaft and therefore, there is achieved an effect of facilitating to carry out operation of cleaning the thermal head or interchanging the thermal head.

According to the invention of Claim 2, the paper feeding means is attached to the second head holding member and therefore, when the interval between the thermal head and the platen roller is opened by pivoting the head holding member, the paper feeding means is also pivoted along therewith and therefore, in operation of cleaning the thermal head or interchanging the thermal head, the paper feeding means is moved to a position of not hindering the operation and an effect promoting operability is achieved.

According to the invention of Claim 3, a side portion of the platen roller is provided with a gear transmission mechanism for driving to rotate the platen roller, the paper feeding means is provided with a rotating shaft arranged in parallel with the thermal head and a gear attached to an end portion of the rotating shaft, and the gear is constituted to be brought in mesh with any of gears constituting the gear transmission mechanism for driving to rotate the platen roller when the thermal head is brought into a state of being brought into contact with the platen roller and therefore, the paper feeding means can be driven to rotate by a drive source common to that of the platen roller and an effect of capable of downsizing a total of the apparatus is achieved.

According to the invention of Claim 4, the paper feeding means includes two rotating shafts arranged in parallel with the thermal head, a belt wound around the two rotating shafts and a gear attached to an end portion of either one shaft of the two rotating shafts and the gear is constituted to brought in mesh with any of gears constituting the gear transmission mechanism for driving to rotate the platen roller when the thermal head is brought into a state of being brought into contact with the platen roller and therefore, a distance of moving the sheet is prolonged and the sheet can firmly be moved and an effect of capable of separating the sheet from the head by a constant distance and thereafter holding the sheet is achieved.

According to the invention of Claim 5, a plurality of pieces of the belts are wound therearound at predetermined intervals along a length direction of the two rotating shafts and therefore, a contact area of an adhering face of the activated sheet and the belt is reduced and an effect of capable of preventing the sheet from adhering to the belt to be entrapped thereby is achieved.

According to the invention of Claim 6, the first head holding member is provided with heat radiating means for escaping heat generated at the thermal head and therefore, it can be avoided that temperature of the thermal head becomes excessively high, when the interval between the thermal head and the platen roller is opened by pivoting the head holding member holding the thermal head, the heat radiating means is also pivoted along therewith and therefore, in operation of cleaning the thermal head or interchanging the thermal head, the heat radiating means is moved to a position of not hindering the operation and an effect of promoting operability is achieved.

According to the invention of Claim 7, a side wall of the main body frame is provided with a locking pin; a side portion of the first head holding member is attached with a coupling piece having a recessed portion engageable with the locking pin pivotably by a third support shaft and the first head holding member and the second head holding member are constituted to be integrated with the frame by engaging the locking pin and the recessed portion to thereby hold the thermal head in a state of being brought into contact with the platen roller and therefore, there is achieved an effect of capable of integrating the head holding member to the frame by only pivoting the head holding member in a direction of making the thermal head proximate to the platen roller.

What is claimed is:

1. A thermally activating apparatus comprising:

a main body frame; a thermal head for heating a sheet; a first head holding member for holding the thermal head from a back portion thereof; a platen roller arranged in parallel with the thermal head; paper feeding means for transporting the sheet after having been heated by the thermal head; and a second head holding member having a first support shaft in parallel with the thermal head for holding the first head holding member pivotably by the first support shaft, wherein the second head holding member is pivotably supported by a second support shaft arranged in parallel with the thermal head and transversely hung rotatably between side walls of the main body frame and the thermal head is constituted to be able to be proximate to and remote from the platen roller by constituting centers of rotation by two shafts of the first support shaft and the second support shaft.

2. The thermally activating apparatus according to claim 1, wherein the paper feeding means is attached to the second head holding member.

3. The thermally activating apparatus according to claim 2, wherein a side portion of the platen roller is provided with a gear transmission mechanism for driving to rotate the platen roller, the paper feeding means is provided with a rotating shaft arranged in parallel with the thermal head and a gear attached to an end portion of the rotating shaft, and the gear is constituted to be brought in mesh with any of gears constituting the gear transmission mechanism for driving to rotate the platen roller when the thermal head is brought into a state of being brought into contact with the platen roller.

4. The thermally activating apparatus according to claim 2, wherein the paper feeding means comprises two rotating shafts arranged in parallel with the thermal head, a belt wound around the two rotating shafts and a gear attached to an end portion of either one shaft of the two rotating shafts and the gear is constituted to be brought in mesh with any of gears constituting the gear transmission mechanism for driving to rotate the platen roller when the thermal head is brought into a state of being brought into contact with the platen roller.

5. The thermally activating apparatus according to claim 4, wherein a plurality of pieces of the belts are wound therearound at predetermined intervals along a length direction of the two rotating shafts.

6. The thermally activating apparatus according to claims 1, wherein the first head holding member is provided with heat radiating means for escaping heat generated at the thermal head.

7. The thermally activating apparatus according to claim 1, wherein a side wall of the main body frame is provided with a locking piece, a side portion of the first head holding member is attached with a coupling piece having a recessed portion engageable with the locking piece pivotably by a third support shaft and the first head holding member and the second head holding member are constituted to be integrated with the frame by engaging the locking piece and the recessed portion to thereby hold the thermal head in a state of being brought into contact with the platen roller.

* * * * *